United States Patent [19]

Hayatdavoudi

[11] Patent Number: 4,823,919

[45] Date of Patent: Apr. 25, 1989

[54] SLIP CONSTRUCTION FOR SUPPORTING TUBULAR MEMBERS

[75] Inventor: Asadoallah Hayatdavoudi, Lafayette, La.

[73] Assignee: Premiere Casing Services, Inc., Lafayette, La.

[21] Appl. No.: 149,540

[22] Filed: Jan. 28, 1988

Related U.S. Application Data

[63] Continuation of Ser. No. 907,492, Sep. 15, 1986, abandoned, which is a continuation of Ser. No. 551,833, Nov. 15, 1983, abandoned.

[51] Int. Cl.[4] ..... B65H 59/10

[52] U.S. Cl. ..... 188/67; 285/144; 294/102.2; 403/377; 188/244; 188/251 M

[58] Field of Search ..... 188/67, 251 M, 244, 188/250 G, 250 B; 285/144–148; 294/102.2; 403/377

[56] References Cited

U.S. PATENT DOCUMENTS

| | | | |
|---|---|---|---|
| 1,381,074 | 6/1921 | Livergood | 188/67 |
| 1,469,894 | 10/1923 | Clarke | 189/67 |
| 1,501,962 | 7/1924 | Montgomery | 188/67 |
| 1,560,701 | 11/1925 | Layton | 188/67 |
| 1,625,540 | 4/1927 | Hertzberg | 188/67 |
| 1,691,384 | 11/1928 | Edwards et al. | 175/422 |
| 1,794,662 | 3/1931 | Zerr | 285/144 X |
| 1,834,316 | 12/1931 | McLagan | 175/422 |
| 1,934,448 | 11/1933 | Roth | 188/250 G X |
| 1,966,454 | 7/1934 | Moody | 188/67 |
| 2,061,771 | 11/1936 | McLagan | 24/263 |
| 2,061,772 | 11/1936 | McLagan | 24/263 |
| 2,071,637 | 2/1937 | Laurent | 188/67 |
| 2,288,851 | 7/1942 | Sharp | 24/263 |
| 3,052,943 | 9/1962 | Jones | 188/67 X |
| 3,130,987 | 4/1964 | Johnson | 285/146 |
| 3,140,523 | 7/1964 | Taylor, Jr. | 24/263 |
| 3,358,341 | 12/1967 | Brustall | 244/102 A |
| 3,748,702 | 7/1973 | Brown | 188/67 |
| 4,381,584 | 5/1983 | Coyle, Sr. | 24/263 D |

FOREIGN PATENT DOCUMENTS

| | | | |
|---|---|---|---|
| 806426 | 2/1952 | Fed. Rep. of Germany | 175/423 |

*Primary Examiner*—George E. A. Halvosa

*Attorney, Agent, or Firm*—Laney, Dougherty, Hessin & Beavers

[57] ABSTRACT

A support construction including a supporting bowl to receive a plurality of circumferentially disposed slips to engage and support a tubular member. The slips include at least one pair of slip inserts that are carried in axial grooves provided on the innermost surfaces of the slips, the inserts provided as a pair of cooperating, interengaging members, the innermost slip insert relative to the tube having inwardly extending teeth to engage the tube outer surface. The inner and outer slip inserts are made from materials having a different modulus of elasticity, the modulus of elasticity of the innermost slip insert, relative to the tube axis, having a modulus of elasticity from about 3 to about 7 times greater than that of the outer slip insert, relative to the tube axis.

5 Claims, 4 Drawing Sheets

SLIP CONSTRUCTION FOR SUPPORTING TUBULAR MEMBERS

This is a continuation of application Ser. No. 907,492 filed Sept. 15, 1986, now abandoned, which was itself a continuation of application Ser. No. 551,833 filed Nov. 15, 1983, now abandoned.

BACKGROUND OF THE INVENTION

1. Field of the Invention

This invention relates to a slip construction for supporting tubular members such as well casings, tubular hangers packer inserts, tubing slips, liner hangers, and the like, and more particularly to a well casing slip having a slip insert construction that provides reduced surface deformation of a well casing while maintaining sufficient gripping force thereon to hold and support such a casing in the course of well drilling operations.

2. Description of the Prior Art

In the course of drilling oil and gas wells, a bore hole is drilled in the earth to a sufficient depth to provide communication with and to permit withdrawal of the subterranean oil and gas deposits. A well casing of generally tubular configuration, such as a pipe, is inserted into the bore hole in order to provide an escape path for drilling debris, for the oil or gas, and simultaneously to prevent the collapse of the side walls of the bore hole and the consequent filling or plugging up of the hole with earth. The casing is handled by means of a device referred to as an elevator, which includes a generally bowl-shaped annular housing within which several wedges, commonly referred to as slips, are positioned, the slips having inwardly directed gripping surfaces to engage and grip the exterior surface of a casing.

The gripping surfaces include numerous inwardly directed teeth that are adapted to engage the outer surface of the casing in order to securely hold it in position and permit it to be transported vertically into the bore hole. Generally, the slip insert materials in common use are very rigid and hard materials that have a damaging effect on the pipe they are intended to hold. The damaging effect is manifested in partial embedment of the insert teeth in the surface of the wall of the casing. The embedment results from the gripping forces and from the hardness of the slip assembly (slip and insert) material, which is generally two to three times higher than the surface hardness of the usual oil field tubular goods. Additionally, the hardness of the slip insert material increases with use because of the effect of work-hardening. The embedment of the teeth in the casing surface causes depressions, resulting in localized higher stresses in the casing when it is subjected to axial loading, because the portions of the casing having the depressions have a smaller effective cross-sectional area. Additionally, some of the slips in general use are retained in an annular retainer commonly referred to as a bowl, and any slight misalignment of the innermost surfaces of the slips with respect to the casing surface results in unequal hoop stresses being applied to the casing, further contributing toward localized surface deformation, bending of the casing wall, and consequent increased localized stresses at those areas.

In addition to well casings, other tubular members such as tubing hangers, liner hangers, packer inserts, and the like, also involve gripping operations, either externally or internally of the tubular member, and similar problems are involved in the gripping and handling of such members.

It is thus an object of the present invention to overcome the above-noted problems.

SUMMARY OF THE INVENTION

Briefly stated in accordance with one aspect of the present invention, a well casing support construction is provided and includes an annular housing having a bowl-like shape and a central aperture through which a well casing can pass. The housing aperture defines an inner wall that tapers to a minimum diameter at one end thereof and a maximum diameter at the other end thereof and also includes an inwardly directed land at the minimum diameter to serve as an abutment. A plurality of circumferentially disposed slips are positioned within the bowl to surround the casing, the slips having a tapered outer surface to engage the tapered inner wall of the bowl and an axially positioned inner surface thereof including an axial groove. At least one pair of slip inserts is carried in the groove of each slip, the inserts having cooperating interengaging surfaces. The innermost slip insert, relative to the well casing, has inwardly extending teeth to engage the outer surface of the casing and it is made from a material having a modulus of elasticity of from about 3 to about 7 times greater than that of the other slip insert. The slip inserts are received in the axial groove of the slip.

DESCRIPTION OF THE PREFERRED EMBODIMENTS

Figure 1:
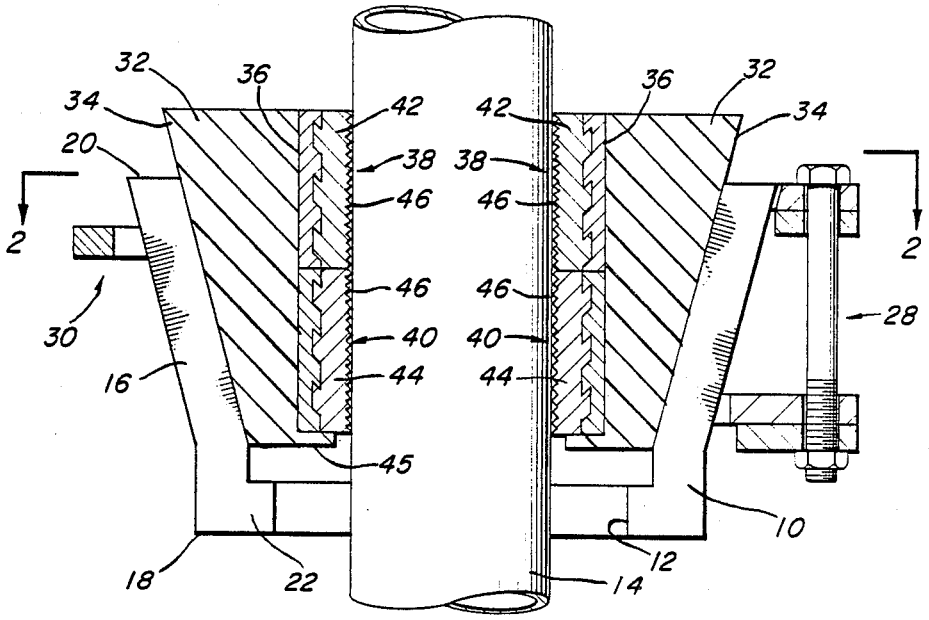
FIG. 1 is a vertical cross-sectional view of a bowl for use in a well casing elevator and shows a bowl, four pairs of slip inserts in accordance with the present invention, and a fragmentary portion of a casing supported thereby.
Figure 2:
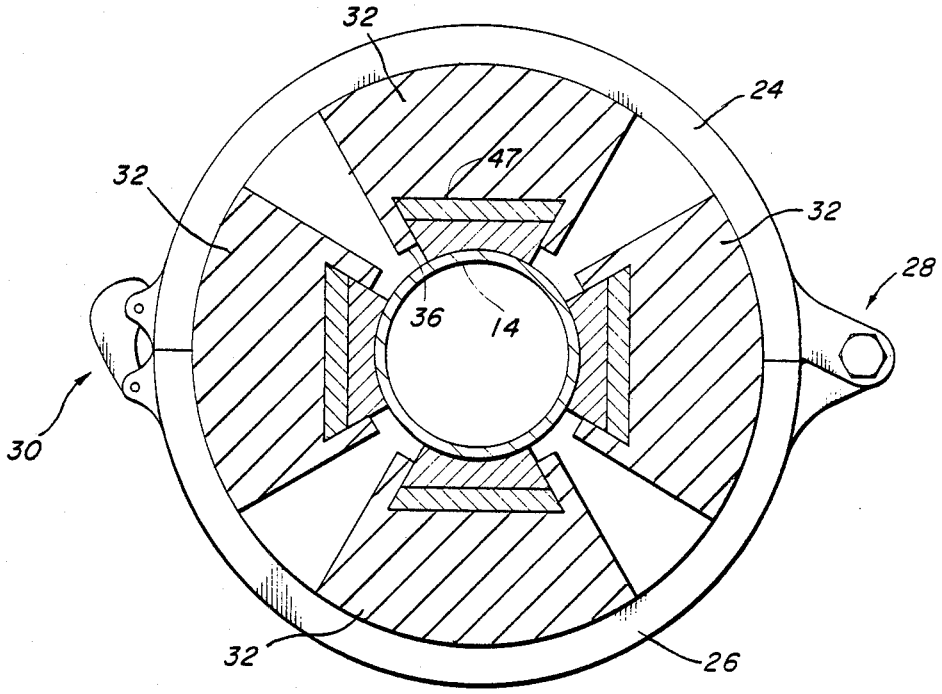
FIG. 2 is a transverse cross-sectional view of the bowl of FIG. 1 taken along the line 2—2 thereof.

Referring now to the drawings, and particularly to FIGS. 1 and 2, there is shown a bowl 10 in the form of an annular housing having a central aperture 12 through which a well casing 14 can pass. Bowl 10 is defined by a wall 16 that tapers upwardly and outwardly to define a reduced diameter end 18 thereof and an enlarged diameter end 20 at the other end thereof. The reduced diameter end includes an inwardly directed land 22 that serves as an abutment. The bowl is split axially into two parts 24, 26 connected by a hinge 28 that permits the two parts to be swung open to receive a casing, and it includes suitable locking means 30 to securely hold the two parts in a closed position.

Positioned within bowl 10 in circumferentially spaced relationship are a plurality of slips 32 having a wedge-shaped cross-section and a tapered outermost surface 34 that engages with the tapered inner surface of bowl 10. The innermost surface 36 of the slips is preferably concentric with that of the well casing. As shown, the casing support includes four slips, each of two pairs being in opposed relationship relative to casing 14 for uniform application of the gripping loads. However, if desired, three equidistantly spaced slips can also be provided, as can a smaller number or a number greater than four. Axial movement of the slips through the bowl is prevented by abutment land 22.

Slips 32 and bowl 10 are generally made from a high strength steel having a high yield strength in order to support a long, and consequently heavy, well casing that can extend for a length of thousands of feet, depending upon the depth of the particular well being drilled.

Carried in each of slips 32 are two pairs of slip inserts 38, 40, the inserts provided as two interengaged members that extend in a generally axial direction relative to the casing. The innermost members 42, 44, relative to the casing, have a plurality of teeth 46 to engage and grip the exterior surface of the casing. Teeth 46 can be in the form of horizontally-extending serrations that include vertically spaced grooves for effective gripping engagement of the casing. The interengaged inserts are so configured that together they define a dovetail in cross section, as shown in FIG. 2, and are received in an axially extending dovetail groove 47 formed on the innermost surface of the slip. Axial movement of the inserts is prevented by retaining land 45. Although each of the slips includes several pairs of slip inserts 38, 40, carried in dovetail grooves 47, the benefits of the invention can be obtained if one or more of such inserts is provided in each slip. However, it is preferred that a large gripping surface area be provided and therefore two or more sets of axially aligned slip inserts are utilized in order to obtain the desired gripping area.

Figure 3:
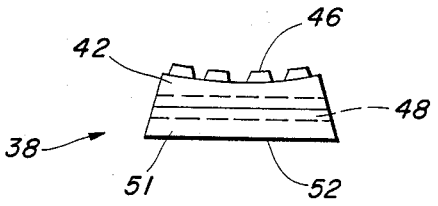
FIG. 3 is an enlarged end view showing an assembled upper slip insert.
Figure 4:
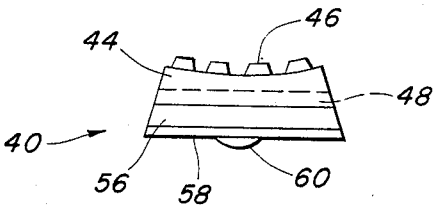
FIG. 4 is an enlarged end view showing an assembled lower slip insert.
Figure 5:
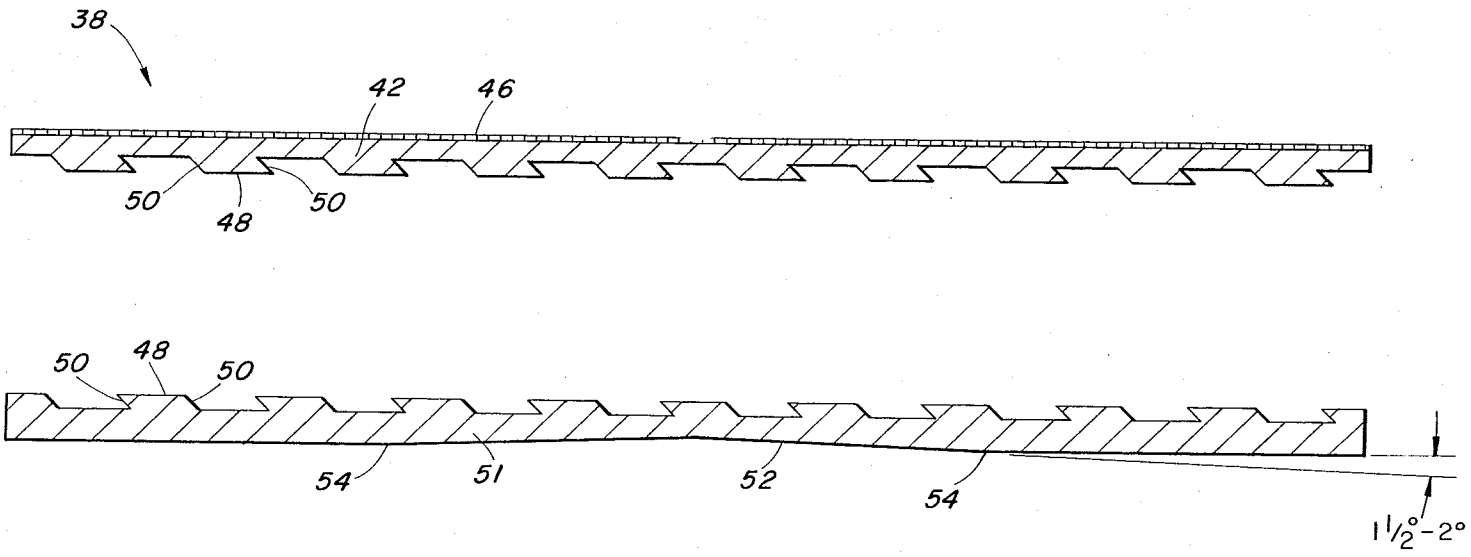
FIG. 5 is an enlarged axial section showing the upper inserts in spaced condition.
Figure 6:
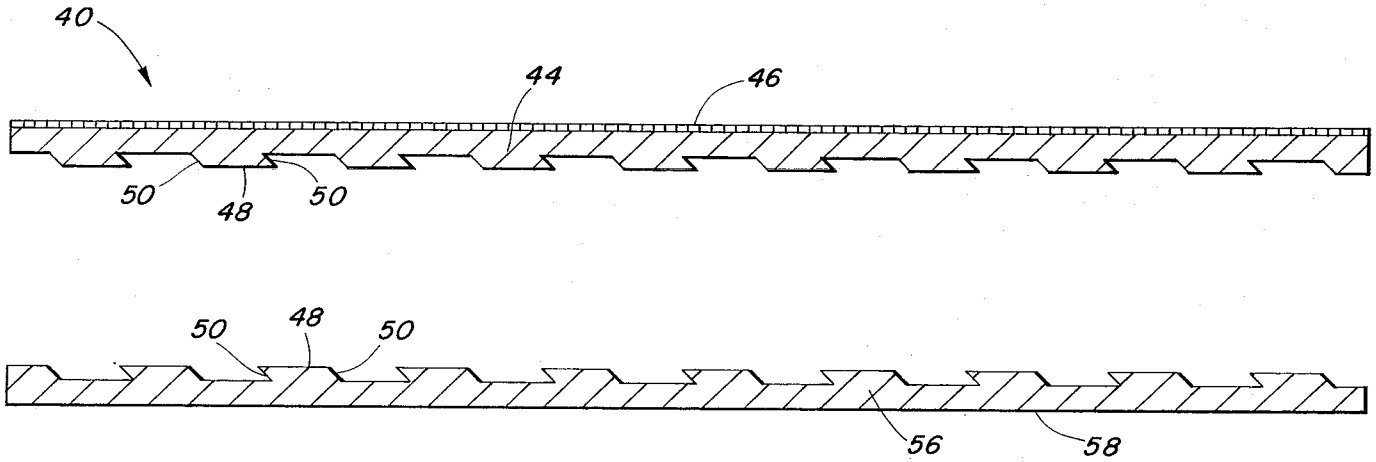
FIG. 6 is an enlarged axial section showing the lower inserts in spaced condition.

FIGS. 3 and 4 show end views of the assembled slip inserts for the upper slip insert assembly 38 and the lower slip insert assembly 40, respectively, while FIGS. 5 and 6 show enlarged axial sections of the upper and lower backing of inserts, 38, 40, respectively, when the two parts thereof are spaced from each other. As can best be seen from FIGS. 5 and 6, the respective slip insert parts include cooperating, interengaging surfaces in the form of spaced, transversely disposed lugs 48, the lugs having transverse end surfaces 50 that are inclined with respect to the casing axis. Additionally, the outermost portion 51 (see FIG. 5), relative to the casing axis, of the upper set of slip inserts has an outer surface 52 that is inwardly tapered from points 54 spaced inwardly of each axial end thereof to provide an outer portion that has a minimum wall thickness adjacent the axial midpoint and that tapers outwardly to a maximum wall thickness at points adjacent to but spaced from each end. As illustrated in FIG. 6, the outermost portion 56, relative to the casing axis, of the lower slip assembly has an outer surface 58 having a uniform taper and is thicker at the lower end than it is at the upper end thereof. Additionally, and as best seen in FIG. 4, the outer surface 58 of the lower pair of slip insert backing 40 preferably includes an outwardly extending protrusion 60 that engages with a correspondingly shaped, but shallower, depression (not shown) in its associated slip in order to provide a pivot axis to permit the lower die assembly to rock slightly about the pivot axis to assume a position whereby maximum contact and prependicularity results between the casing-engaging teeth and the casing outer surface, in order to compensate for any surface irregularities that may exist in the casing or in the slip and bowl assembly. Also as can be seen in FIGS. 3 and 4, the tube-engaging teeth 46 are of a greater depth in the lower slip insert assembly 40 as compared with those of the upper slip assembly 38, because the former carry a larger portion of the load that results from the weight of the casing section being carried or supported.

The innermost portions 42, 44 of the respective slip assemblies that carry the tube-engaging teeth 46 are preferably made from a material with a higher modulus of elasticity than that of the radially outermost portions thereof 51, 56, respectively. It has been found that by providing such a difference in modulus of elasticity, the resulting loading on the external surface of the casing is more uniform, and the tendency of the tube-engaging teeth to embed themselves deeply into the tube wall is substantially reduced, thereby reducing the localized stresses to which the respective tubular sections are subjected. Preferably the difference in modulus of elasticity is such that the radially innermost portions 42, 44 of the slip assemblies 38, 40, have a modulus of elasticity of about three times that of the radially outermost portions 51, 56. However, effective performance can be obtained when the range of the multiple of the modulus of elasticity is from about 3 to about 7:1.

Preferably, the material from which the radially innermost portions 42, 44 of the slip assemblies is made has a surface hardness approximating that of the casing, or slightly less. Suitable materials from which the radially outwardly positioned portions 51, 56 of the slip assemblies can be made are materials having a substantially lower modulus of elasticity such as, for example, various copper or copper-beryllium alloys, aluminum alloys, composite materials, hard surfaced structural grade plastics, or the like.

In addition to the applicability of such a slip and slip insert assembly to the external gripping supporting of tubular members, the benefits of the present invention can also be obtained when such a slip insert construction is used to provide internal gripping and supporting of tubular members, as long as the inserts have a suitable surface shape and configuration to correspond with the shape of the surface being gripped.

Although particular embodiments of the present invention have been illustrated and described, it will be apparent to those skilled in the art that various changes and modifications can be made without departing from the spirit and scope of the invention, and it is intended to cover in the appended claims all such changes and modifications that fall within the scope of the present invention.

What is claimed is:

1. A holder apparatus for axially receiving and carrying a well casing for an oil or gas well, said holder apparatus comprising:

housing means having a tapered inner wall;

a plurality of slips having a tapered radially outer surface engaging said tapered inner wall of said housing means, and having a dovetail transverse cross-section axial groove disposed in a radially inner surface thereof;

at least one pair of slip inserts received and radially retained in said dovetail groove of each of said slips, said pair of slip inserts including:

a radially inner insert means having a toothed radially innermost surface for engaging and supporting said well casing; and a radially outer insert means for supporting a radially outer surface of said inner insert means; and wherein said outer insert means has a modulus of elasticity from about one-third to about one-seventh a modulus of elasticity of said inner insert means.

2. The apparatus of claim 1, wherein:

said outer insert means in constructed of aluminum, and said outer insert means has a modulus of elasticity about one-third of said modulus of said inner insert means.

3. The apparatus of claim 1, further comprising:

at least a second pair of such slip inserts received and radially retained in said dovetail groove of each of said slips, said second pair of slip inserts being axially stacked on said first pair of slip inserts.

4. The apparatus of claim 1, wherein:

said inner and outer inserts have substantially uniform transverse cross-section shapes along their axial length.

5. The apparatus of claim 1, wherein:

said outer insert means is axially unconfined at an upper end of said dovetail groove.

* * * * *